United States Patent [19]

Thomas

[11] 4,315,111

[45] Feb. 9, 1982

[54] HEARING AID WITH REMOTE MOMENTARY SHUT OFF SWITCH

[76] Inventor: Charles A. Thomas, 609 S. Warson Rd., St. Louis, Mo. 63124

[21] Appl. No.: 154,367

[22] Filed: May 29, 1980

[51] Int. Cl.[3] ..... H04R 25/00

[52] U.S. Cl. ..... 179/107 R; 200/61.58 R; 200/DIG. 2

[58] Field of Search ..... 179/1 SW, 107 R, 158 R; 200/61.58 R, DIG. 2

[56] References Cited

U.S. PATENT DOCUMENTS

| | | | |
|---|---|---|---|
| 1,211,976 | 1/1917 | Spencer et al. | 179/158 |
| 2,106,658 | 1/1938 | Rakos | 200/DIG. 2 |
| 2,267,489 | 12/1941 | Brockhurst | 179/107 R |
| 2,406,583 | 8/1946 | Blauvelt | 179/107 |
| 2,979,845 | 4/1961 | Christiansen | 42/70 |
| 3,306,991 | 2/1967 | Wood | 179/107 R |
| 3,363,242 | 1/1968 | Currey et al. | 200/DIG. 2 |
| 3,586,798 | 6/1971 | Holmes | 200/DIG. 2 |

FOREIGN PATENT DOCUMENTS

| | | | |
|---|---|---|---|
| 1227835 | 4/1971 | United Kingdom | 200/DIG. 2 |

OTHER PUBLICATIONS

U.S. Patent Office Official Gazette, Feb. 17, 1942, p. 529, Item 2,273,204.

U.S. Patent Office Official Gazette, Dec. 1953, pp. 355-356, Item 2,661,561.

*Primary Examiner*—George G. Stellar

*Attorney, Agent, or Firm*—Rogers, Eilers & Howell

[57] ABSTRACT

A battery powered hearing aid has a remote, momentary shut off switch comprised of two leaf plates mounted in a spaced apart relationship, with each leaf plate having an electrical contact extending inwardly and aligned so that pressure against either leaf plate separates the contacts to open an electrical circuit. When the switch is opened, power from the battery is disconnected from the hearing aid, rendering it non-operational while the leaf plates are under pressure. The remote momentary shut off switch is particularly adapted for mounting in the shoulder area of a hunting vest or the like to permit improved hearing while stalking a quarry without amplifying the firing noise from a shotgun or rifle.

15 Claims, 9 Drawing Figures

HEARING AID WITH REMOTE MOMENTARY SHUT OFF SWITCH

BACKGROUND AND SUMMARY

One of the exhilarating parts of quail hunting is hearing a covey of birds take flight when flushed by a favorite hunting dog. The rushing, whooshing sound is at once startling and exciting, representing the thrill of the hunt desired to be experienced by all hunters. The sound of a covey "getting up" also alerts the hunter, oftentimes before he catches sight of the covey, and helps to improve a hunter's likelihood of bagging a bird. It is believed that the flapping, whooshing noise helps orient the hunter and focus his attention to a specific portion of his field of view much quicker than with sight alone. Thus, it is important for a hunter to be able to hear as he hunts so that he may fully experience the thrill and excitement of flushing his quarry and also enhance his likelihood of climaxing his efforts with a kill.

Unfortunately, the hunter with impaired hearing cannot fully experience the joy of flushing a covey of quail and is further handicapped in locating and shooting his quarry, for the reasons mentioned above. While most hearing problems can be at least partially corrected through the use of hearing aids, the hunter must guard against amplifying the sound of his own weapon as it would very likely further damage his hearing capacity. In this regard, it is widely recommended that all hunters including those having normal hearing use ear plugs to muffle the severe and extreme noises generated by a firing shotgun to prevent damage to the hearing. Therefore, a hunter with impaired hearing must make the unhappy choice of stopping before shooting to turn off his hearing aid or not wearing one and missing what some consider to be the most exhilarating part of the hunt. If a hunter chooses to wear his aid, he must be very careful to remember and turn it off before firing as he can inadvertently cause himself serious pain and further hearing loss. For this reason, it is considered dangerous for a hunter to wear an aid while hunting.

To solve these problems and enable a hearing impaired hunter to fully experience the thrill of the hunt and also prevent the unintended amplification of his own shotgun fire, applicant has succeeded in developing a remote, momentary shut off switch for automatically and reliably disabling a hearing aid as the shotgun or rifle is raised into the firing position and pressed against the shoulder. The remote shut off switch may be mounted to a hunting vest, jacket or the like in the crook of the shoulder where the hunter customarily rests his gun before firing. Thus, a hearing impaired hunter may confidently wear a hearing aid to fully experience the sounds around him and use them in locating his quarry and aiming his gun. However, just before firing his gun, every hunter habitually exerts a rearward pressure with the gun butt against his shoulder, automatically operating the remote switch to shut off the hearing aid and prevent it from amplifying the firing noise. Firmly seating the gun butt into the crook of the shoulder is a habit well learned early on in shooting and is virtually a reflex action. This is because a failure to properly seat a shotgun or rifle results in a badly bruised or even broken shoulder when the gun recoils into it. The automatic and reliable operation of the switch is thus assured.

Applicant's remote, momentary shut off switch is of further benefit as it requires virtually no adjustment in a hunter's normal shooting motion. As can be appreciated, any system which interferes with the natural shooting routine of a hunter would not only detract from the very thing sought to be enhanced, but could also preserve some element of danger from the simple manual system of the prior art. With applicant's device, it is expected that a hunter might delay his firing until he had heard the aid go silent while first using it. However, further use would bring confidence in its reliability such that a hunter would soon return to his natural firing routine. Thus, use of applicant's device offers the many advantages of improved hearing with only a small intrusion into the shooting routine, and then only if such instrusion is desired. Otherwise, a hunter would soon return to his normal routine.

Applicant's remote, momentary contact shut off switch generally includes two leaf plates fastened together in a spaced apart relationship with silver tipped contacts extending inwardly from each plate and interlocked so that pressure against the plates separates the contacts and breaks the circuit between the battery and the hearing aid. The leaf plates may be as small or as large as desired and one or more sticky fabric patches, such as VELCRO TM, may be attached to the switch and a matching sticky fabric patch secured to the inside of the hunting vest for securing the switch. With this mounting arrangement, the switch may be easily removed for washing of the vest or for using the switch with other vests. Of course, the switch may be secured to a hunting vest or jacket in a myriad of ways, some of which would provide more flexibility in adjusting the positioning of the switch to accommodate different wearers of the jacket. With the VELCRO TM patches, a wide range of adjustability of placement is provided and might be more desirable for the mass production of applicant's device. Once a desirable position has been found, then it may be marked by the hunter so that its position may be easily duplicated after the switch is removed for washing of the jacket or the like.

Applicant's remote, momentary shut off switch may be used with any of the wide variety of hearing aids presently available; from the totally in the ear devices to those having a separate receiver and pocket carried amplifier. Applicant discloses one embodiment of his invention with a pocket carried amplifier but it is to be understood that applicant's switch may be used with a wide variety of hearing aids.

BRIEF DESCRIPTION OF THE PREFERRED EMBODIMENT

Figures 1, 2, 3, 4, 5, 6, 7, 8, 9:
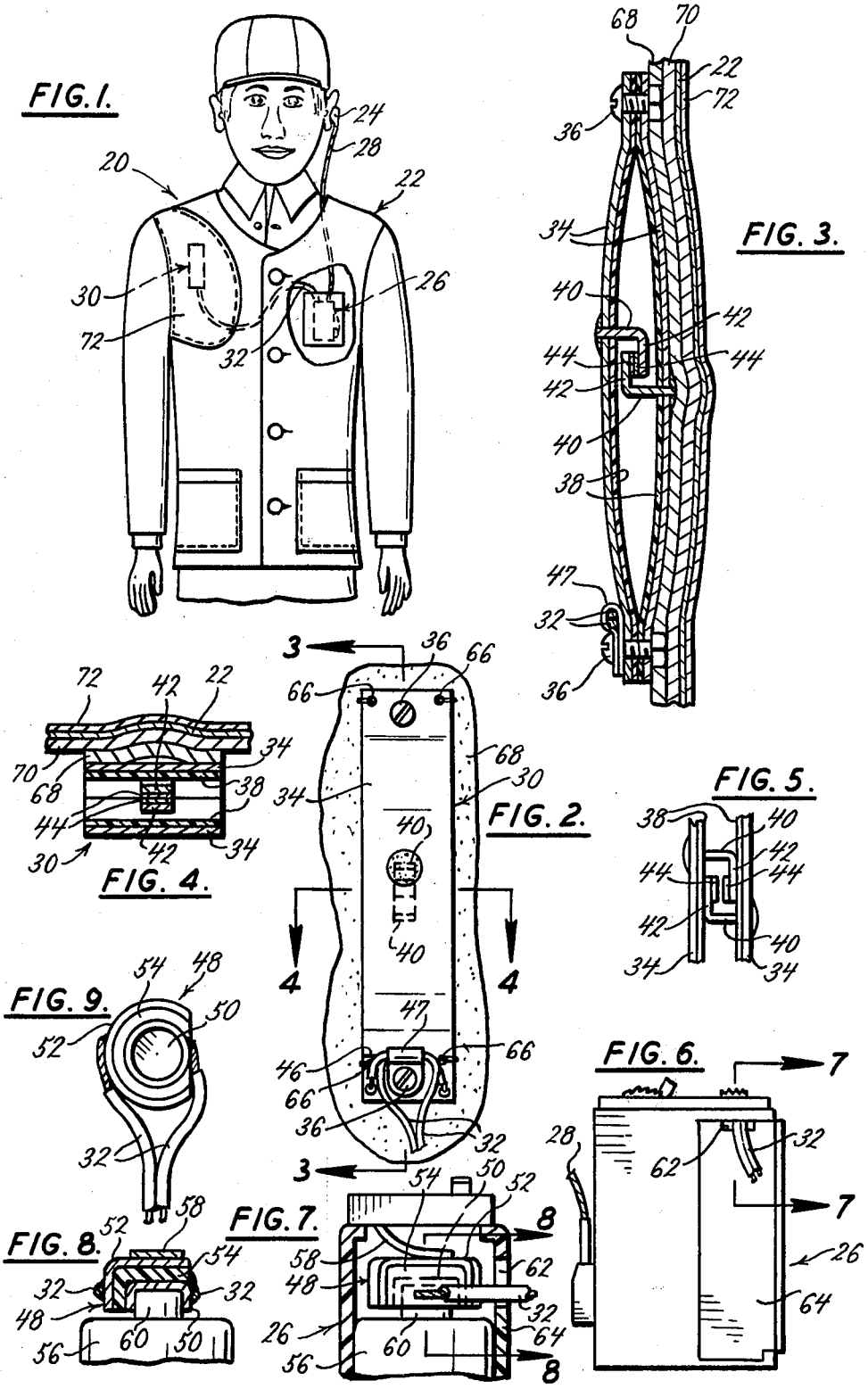
FIG. 1 is a view of a hunter wearing a vest and hearing aid with applicant's remote shut off switch secured to the vest.
FIG. 2 is an enlarged view of the remote, momentary switch.
FIG. 3 is a cross-sectional view taken along the plane of line 3—3 in FIG. 2 showing the remote switch in greater detail.
FIG. 4 is a cross-sectional view taken along the plane of line 4—4 in FIG. 2 showing the contact point of the contacts.
FIG. 5 is an enlarged partial cross-sectional view showing the maximum inward deflection of the leaf plates as limited by the contacts.
FIG. 6 is an enlarged view of the pocket amplifier.
FIG. 7 is a cross-sectional view taken along the plane of line 7—7 in FIG. 6 showing the battery cap mounted on the battery in the pocket amplifier.
FIG. 8 is a cross-sectional view taken along the plane of line 8—8 in FIG. 7 showing the compound construction of the battery cap.
FIG. 9 is an enlarged bottom view of the battery cap.

Applicant's hearing aid and remote, momentary shut off switch device 20 is shown in FIG. 1 installed on a hunting jacket 22 and includes a receiver 24 for attachment to the hunter's ear, an amplifier unit 26 which is carried in any convenient pocket with a twisted wire pair 28 extending between the receiver 24 and amplifier unit 26, as is known in the art. What has been described so far generally comprises a hearing aid of one particular type. It is to be understood that other types of hearing aids including those battery powered hearing aids which fit entirely within the ear, and those of the "earette" type which curl around the back of the ear, or any other type of hearing improvement device may be used with applicant's invention.

A remote, momentary shut off switch 30 is shown attached to the inside of the shoulder area of the hunting jacket 22 with a wire pair 32 extending to the amplifier unit 26. As shown in more detail in FIGS. 2, 3, 4 and 5, the remote, momentary shut off switch 30 is generally comprised of a pair of leaf plates 34 of a generally rectangular shape and joined at either end by a bolt and nut 36. The leaf plates 34 may be constructed of any electrically conductive material such as copper, silver or the like and the bolt and nut fastener 36 can be any type of electrically insulating material such as nylon or the like. The leaf plates 34 are pre-stressed into a bowed orientation so that when they are fastened together they do not lie flatly adjacent one another but instead remain in a spaced apart condition, especially towards their center, as shown in FIG. 3. A layer of insulating material 38 such as electrician's tape or the like is secured to the inner surface of each leaf plate 34 to insulate the leaf plates 34 and prevent shorting of the switch 30, as is explained in more detail hereinafter. Near the approximate center of each leaf plate 34, a contact post 40 extends inwardly therefrom and a flattened contact head 42 is formed at the end of contact post 40 in an approximately L-shaped configuration. This is best shown in cross-sectional detail in FIG. 3. As can be seen from the drawing, the contact heads 42 are positioned such that they interlock and touch one another along their tip surfaces 44. The stress placed in the leaf plates 34 provides the contact pressure tending to urge one contact surface 44 against the other. These tip surfaces 44 may be silver or gold to increase the electrical conductivity of the switch 30 and enhance low contact pressure switching, as is known in the art.

An additional advantage to the flattened contact heads 42 is that while pressure against leaf plates 34 separate the tip surfaces 44, excess pressure will cause the contact heads 42 to rest against the opposite leaf plate 34 and resist further pressure which might otherwise tend to deform the switch 30. This is best shown in FIG. 5. As can be appreciated, a substantial pressure may be applied as the butt of a gun is brought rapidly into contact with the switch 30. Therefore, this construction of the contact posts 40 and contact heads 42 helps minimize the possibility of damage to the switch 30 during use. Furthermore, this construction also limits the amount of deflection which can be imposed on leaf plates 34 which improves the life of the switch 30 by preventing over-travel and loss of contact pressure caused by loss of the bowing of leaf plates 34.

In applicant's preferred embodiment, one end of wire pair 32 is connected to the switch 30 by soldering or the like. As shown in FIG. 2, one corner 46 is cut away to expose both leaf plates 34 and a wire clip 47 is secured to bolt and nut 36 and acts as a strain relief for wire pair 32. One wire from wire pair 32 is connected to each of the leaf plates 34. The opposite end of wire pair 32 leads to amplifier 26 as shown in FIG. 6 where it is attached to a battery cap 48 shown in FIGS. 7, 8 and 9 which has an inner cup 50 and an outer cup 52. Cups 50, 52 are electrically isolated from one another by a layer of epoxy 54 or the like. Thus, when switch 30 is closed, inner cup 50 is electrically connected to outer cup 52 through switch 30 and wire pair 32. However, when switch 30 is open, inner cup 50 is electrically isolated from outer cup 52 by epoxy 54, thereby preventing the flow of electricity therebetween. As shown in FIG. 7, battery cap 48 is placed atop the battery cell 56 used to power the amplifier unit 26. The spring clip battery terminal 58 of amplifier unit 26 contact battery cap 48, such that any current leaving the battery must flow through battery cap 48 before entering the amplifier unit 26. A slot 62 is provided in the pivoting battery door 64 to accommodate wire pair 32.

The remote switch 30 has holes 66 at its corners for fastening a patch of VELCRO TM 68 thereto. A matching patch 70 of VELCRO TM is sewn inside the shoulder area of the jacket 22 for receiving the switch 30. This is best shown in FIG. 3. Thus, the remote switch 30 may be easily removed for cleaning of the jacket or the like by "tearing" the VELCRO TM patches 68, 70 apart. An outer shoulder patch 72 is shown in FIG. 1 and in cross-section in FIG. 3 and is generally found on hunting vests to prevent premature wearing out of the shoulder area of the jacket 22.

The operation of applicant's device 20 is automatic once the switch 30 is properly installed and the receiver 24 is placed in the hunter's ear. Switch 30 should be positioned to the inside of the jacket 22 or vest as closely as possible to the exact position on the shoulder where the hunter rests his gun when firing. However, the hunter need not be concerned about carefully placing the gun exactly on the switch each time as the jacket 22 will depress throughout a greater area than that of the butt of the gun. This is especially true if a heavier outer garment is worn over the hunting vest or jacket. The low contact pressure of switch 30 permits this inexact placement of the gun butt against the shoulder which increases the reliability of applicant's device. As explained above, reliability in operation is critical to help prevent the possible pain and further injury caused by amplifying gun fire.

When switch 30 is depressed, contact tips 44 separate thereby breaking the circuit between the cups 50, 52 of battery cap 48. This in effect disconnects the battery 56 and instantaneously causes the hearing aid to go silent. After the gun has been fired, the usual practice is to bring the gun down from the shoulder. This action will automatically reactivate the hearing aid through closure of switch 30 which completes the circuit between battery 56 and spring clip terminal 58.

Various changes and modifications would be apparent to one of ordinary skill in the art as suggested by the teaching of applicant's disclosure. These changes and modifications are included as part of applicant's invention and he intends that his invention be limited only by the scope of the claims appended hereto.

I claim:

1. A battery powered hearing aid with a momentary contact shutoff switch in circuit with said hearing aid, said switch being adapted for mounting to the shoulder area of a hunting vest or the like, said switch having means to interrupt the electrical circuit of said hearing aid as pressure is applied thereto to thereby turn said hearing aid off.

2. The hearing aid device of claim 1 wherein said switch has means to automatically reconnect the electrical circuit of said hearing aid as pressure is removed therefrom.

3. The hearing aid device of claim 1 wherein said switch includes two leaf plates mounted in a spaced apart relationship.

4. The hearing air device of claim 3 further comprising an electrical contact extending inwardly from each of said leaf plates, said contacts aligned with each other so that pressure against either leaf plate separates said contacts.

5. A battery powered hearing aid with a momentary shutoff switch in circuit with said hearing aid, said switch including two leaf plates mounted in a spaced apart relationship, each leaf plate having an electrical contact extending inwardly therefrom, said contacts aligned with each other so that pressure against either leaf plate separates said contacts and thereby turns off said hearing aid, said momentary shutoff switch adapted for mounting to the shoulder area of a vest or the like.

6. The hearing aid device of claim 5 wherein the shutoff switch further comprises electrical insulating material lining the inner surfaces of said leaf plates, said leaf plates being made of material having a relatively high electrical conductivity.

7. The hearing aid device of claim 6 wherein said leaf plates are mounted to each other with at least one electrically insulated fastener.

8. The hearing aid device of claim 5 wherein each contact has a flattened head, said heads being interlocked so that pressure against the leaf plates separates said heads and thereby breaks the electrical circuit therebetween.

9. The hearing aid device of claim 8 wherein the portions of said flattened heads which contact each other are made of silver.

10. The hearing aid device of claim 5 wherein said leaf plates are substantially rectangular with electrically insulated fasteners securing their ends.

11. The device of claim 5 wherein said shutoff switch has a patch of sticky fabric secured thereto, said sticky fabric adapted to engage and hold said switch in contact with a matching pair of sticky fabric in the shoulder area of a vest or the like.

12. The device of claim 5 wherein said shutoff switch is connected in circuit to electrically disconnect the battery from the rest of the hearing aid when said switch is opened.

13. The device of claim 8 further comprising electrical insulating material lining at least a portion of the inner surface of each leaf plate and aligned with said flattened heads so that excess pressure against the leaf plates will not complete an electrical path between a leaf plate and an opposing flattened head.

14. The device of claim 8 wherein excess pressure against the leaf plates brings at least one flattened head into contact with an opposing leaf plate to thereby resist further compression of the leaf plates.

15. A hearing aid with momentary automatic shutoff comprising a receiver for insertion in the ear, a battery powered pocket amplifier in circuit with said receiver, and a momentary shutoff switch in circuit with said amplifier including two leaf plates mounted in opposition to each other, each leaf plate having an electrical contact extending inwardly therefrom, said contacts aligned with each other so that pressure against either leaf plate separates said contacts and thereby turns off said amplifier, said momentary shutoff switch adapted for mounting to the shoulder area of a vest or the like.

* * * * *